US010030364B2

(12) United States Patent
Rosa Neto

(10) Patent No.: US 10,030,364 B2
(45) Date of Patent: Jul. 24, 2018

(54) HYDRAULIC SYSTEM HAVING AUTOMATIC RIDE CONTROL

(71) Applicant: CATERPILLAR INC., Peoria, IL (US)

(72) Inventor: Aristoteles Rosa Neto, St. Charles, IL (US)

(73) Assignee: Caterpillar Inc., Deerfield, IL (US)

( * ) Notice: Subject to any disclaimer, the term of this patent is extended or adjusted under 35 U.S.C. 154(b) by 456 days.

(21) Appl. No.: 14/923,133

(22) Filed: Oct. 26, 2015

(65) Prior Publication Data

US 2017/0114525 A1 Apr. 27, 2017

(51) Int. Cl.
*E02F 9/22* (2006.01)
*E02F 3/42* (2006.01)
(Continued)

(52) U.S. Cl.
CPC ..... *E02F 9/2253* (2013.01); *E02F 3/283* (2013.01); *E02F 3/422* (2013.01); *E02F 9/0883* (2013.01);
(Continued)

(58) Field of Classification Search
CPC ..... E02F 9/2207; E02F 9/2217; E02F 9/2257; E02F 9/2025
See application file for complete search history.

(56) References Cited

U.S. PATENT DOCUMENTS 5,147,172 A 9/1992 Hosseini
5,733,095 A 3/1998 Palmer et al.
5,897,287 A 4/1999 Berger et al.
7,165,395 B2 1/2007 Anderson et al.
(Continued)

FOREIGN PATENT DOCUMENTS

EP 2543777 1/2013
EP 2796625 10/2014
(Continued)

*Primary Examiner* — Erin D Bishop
(74) *Attorney, Agent, or Firm* — Finnegan, Henderson, Farabow, Garrett & Dunner, LLP

(57) ABSTRACT

A hydraulic system is provided for a mobile machine having a lift arm attached to a bucket and a transmission. The hydraulic system may have a hydraulic actuator configured to move the lift arm and bucket. The hydraulic system may further have an accumulator configured to store pressurized fluid and an accumulator valve configured to control fluid flow between the accumulator and the hydraulic actuator, for a ride control mode of operation configured to cushion movement of the bucket. The hydraulic system may also have a lift arm sensor associated with the mobile machine and configured to generate an angle signal indicative of an angle of the lift arm and a speed sensor associated with the mobile machine and configured to generate a speed signal indicative of the speed of the mobile machine. The hydraulic system may further have a controller in communication with the accumulator valve, the lift arm sensor, the speed sensor, and the transmission. The controller may be configured to receive the speed signal, determine a gear setting of the transmission, and receive the angle signal. The controller may also be configured to selectively activate and deactivate the ride control mode of operation based on the speed of the mobile machine and the angle of the lift arm when the gear setting of the transmission is below a minimum gear setpoint.

20 Claims, 5 Drawing Sheets

(51) Int. Cl.

| | |
|---|---|
| ***E02F 9/26*** | (2006.01) |
| ***E02F 3/28*** | (2006.01) |
| ***E02F 9/08*** | (2006.01) |
| *F15B 1/02* | (2006.01) |
| *F15B 21/00* | (2006.01) |

(52) U.S. Cl.

CPC ..... *E02F 9/2207* (2013.01); *E02F 9/2217* (2013.01); *E02F 9/2257* (2013.01); *E02F 9/26* (2013.01); *E02F 9/264* (2013.01); *F15B 1/021* (2013.01); *F15B 21/008* (2013.01); *F15B 2211/20546* (2013.01); *F15B 2211/30575* (2013.01); *F15B 2211/625* (2013.01); *F15B 2211/6303* (2013.01); *F15B 2211/6336* (2013.01); *F15B 2211/6346* (2013.01); *F15B 2211/6658* (2013.01); *F15B 2211/8606* (2013.01); *F15B 2211/8613* (2013.01)

(56) References Cited

U.S. PATENT DOCUMENTS

| | | | | |
|---|---|---|---|---|
| 7,621,124 | B2 | 11/2009 | Mizoguchi et al. | |
| 7,756,622 | B2 | 7/2010 | Gianoglio et al. | |
| 8,307,641 | B2 | 11/2012 | Hanks et al. | |
| 8,387,378 | B2 | 3/2013 | Payne et al. | |
| 9,644,339 | B2 * | 5/2017 | Wada | E02F 3/434 |
| 2010/0024411 | A1 | 2/2010 | Payne et al. | |
| 2012/0180470 | A1 | 7/2012 | Schroeder et al. | |
| 2013/0227937 | A1 | 9/2013 | Dobchuk et al. | |
| 2014/0238007 | A1 | 8/2014 | Payne | |
| 2014/0330490 | A1 | 11/2014 | Aoki et al. | |

FOREIGN PATENT DOCUMENTS

| | | |
|---|---|---|
| KR | 20110008946 A | 1/2011 |
| WO | 2013109814 | 7/2013 |

* cited by examiner

HYDRAULIC SYSTEM HAVING AUTOMATIC RIDE CONTROL

TECHNICAL FIELD

The present disclosure relates generally to a hydraulic system and, more particularly, to a hydraulic system having automatic ride control.

BACKGROUND

Machines such as, for example, dozers, loaders, excavators, motor graders, and other types of heavy equipment use hydraulic actuators coupled to a work implement for manipulation of a load. Such machines generally do not include shock absorbers and, thus, may pitch, lope, or bounce upon encountering uneven or rough terrain. The substantial inertia of the work implement and associated load tends to exacerbate these movements, resulting in increased wear of the machine and discomfort for the operator. Methods and systems for reducing the magnitude of the movements attributable to the work implement have been developed and are commonly referred to as "ride control." One challenge with these systems is developing an efficient protocol for activating and deactivating ride control. Ride control is beneficial when traveling with or transferring a load. It is undesirable, however, to have ride control engaged when a machine is digging in a pile with a bucket because it dampens the force exerted by the bucket and exposes system components to potentially damaging pressure spikes.

One method of determining when to activate and deactivate ride control is described in U.S. Pat. No. 7,621,124 (the '124 patent) issued to Mizoguchi et al. on Nov. 24, 2009. The '124 patent describes a method and device for suppressing travel vibration for a working vehicle using a ride control valve that communicates or cuts off a bottom chamber of a boom cylinder from an accumulator. The '124 patent describes a method of activating ride control or controlling the ride control valve based on a pressure sensor and a travel state detecting sensor. The travel state detecting sensor may constitute a variety of sensors including, for example, a speed sensor, a sensor which can detect a speed gear of a transmission and a rotational speed of an engine, a sensor which can detect the speed gear of the transmission and a stroke position of an accelerator pedal, and a GPS sensor.

Although the system and method of the '124 patent may provide a protocol for activating and deactivating ride control, it may be less than optimal. Specifically, the system and method of the '124 patent may prevent ride control activation in certain operating situations where ride control may be desired, for example, when carrying or transferring a load at lower speed in a low gear.

The disclosed hydraulic system is directed to overcoming one or more of the problems set forth above and/or other problems of the prior art.

SUMMARY

In one aspect, the present disclosure is directed to a hydraulic system for a mobile machine having a lift arm attached to a bucket and a transmission. The hydraulic system may include a hydraulic actuator configured to move the lift arm and bucket. The hydraulic system may further include an accumulator configured to store pressurized fluid and an accumulator valve configured to control fluid flow between the accumulator and the hydraulic actuator, for a ride control mode of operation configured to cushion movement of the bucket. The hydraulic system may also include a lift arm sensor associated with the mobile machine and configured to generate an angle signal indicative of an angle of the lift arm and a speed sensor associated with the mobile machine and configured to generate a speed signal indicative of the speed of the mobile machine. The hydraulic system may further include a controller in communication with the accumulator valve, the lift arm sensor, the speed sensor, and the transmission. The controller may be configured to receive the speed signal, determine a gear setting of the transmission, and receive the angle signal. The controller may also be configured to selectively activate and deactivate the ride control mode of operation based on the speed of the mobile machine and the angle of the lift arm when the gear setting of the transmission is below a minimum gear setpoint.

In another aspect, the present disclosure is directed to a method for controlling motion of a bucket during travel of a machine. The method may include determining a speed of the machine and determining a transmission gear setting of the machine. The method may also include determining an angle of a lift arm attached to the bucket. The method may further include selectively activating or deactivating a ride control mode of operation, based on the speed of the machine and the angle of the lift arm when the gear setting of the transmission is below a minimum gear setpoint.

In another aspect, the present disclosure is directed to a machine. The machine may include a power source, a transmission, and a traction device controlled by the transmission to propel the machine. The machine may further include a bucket attached to a lift arm and a hydraulic actuator configured to move the lift arm and the bucket. The machine may also include a tank configured to hold a supply of fluid and a pump driven by the power source to draw and pressurize fluid from the tank. The machine may further include a valve arrangement configured to control fluid flow between the hydraulic actuator, the tank, and the pump to affect movement of the bucket. The machine may also include an accumulator configured to store pressurized fluid and an accumulator valve configured to control fluid flow between the accumulator and the hydraulic actuator, for a ride control mode of operation. The machine may further include a lift arm sensor associated with the machine configured to generate an angle signal indicative of an angle of the lift arm and a speed sensor associated with the machine configured to generate a speed signal indicative of the speed of the machine. The machine may also include a controller in communication with the valve arrangement, the accumulator valve, the lift arm sensor, the speed sensor, and the transmission. The controller may be configured to receive the speed signal, determine a gear setting of the transmission, and receive the angle signal. The controller may also be configured to selectively activate the ride control mode of operation and open the accumulator valve based on the speed of the machine and the angle of the lift arm when the gear setting of the transmission is below a minimum gear setpoint.

DETAILED DESCRIPTION

Figure 1:
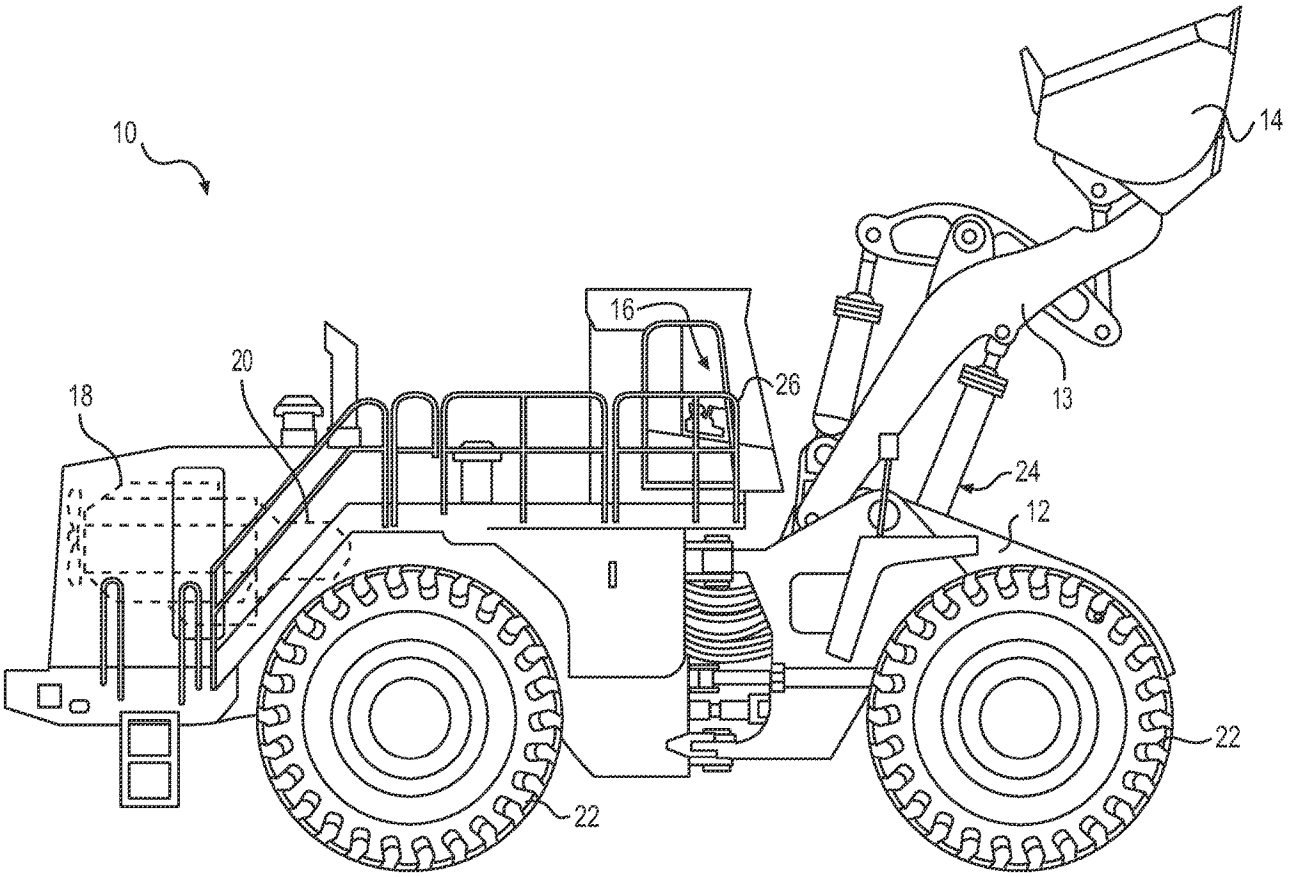
FIG. 1 is a side-view diagrammatic illustration of an exemplary disclosed machine.

FIG. 1 illustrates an exemplary machine 10. Machine 10 may be a mobile machine that performs some type of operation associated with an industry such as mining, construction, farming, transportation, or any other industry known in the art. For example, machine 10 may be an earth moving machine such as a loader. Machine 10 may include a frame 12, a lift arm 13 pivotally attached to frame 12, a bucket 14 movably attachable to lift arm 13, an operator interface 16 associated with operator control of bucket 14, a power source 18 having a transmission 20 operatively connected to drive a traction device 22, and one or more hydraulic actuators 24 connected to move lift arm 13 and bucket 14.

Frame 12 may include any structural member that supports movement of machine 10, lift arm 13, and bucket 14. Frame 12 may embody, for example, a stationary base frame connecting power source 18 to bucket 14, a movable frame member of a linkage system, or any other structural member known in the art.

Numerous lift arm configurations 13 may be attachable to a single machine 10 and controllable via operator interface 16. The configuration of lift arm 13 may vary depending on the intended operation and application. For example, the different lift arm configurations may vary in their dimensions, enabling some to lift, dump, and transfer loads to higher elevations than others. For example, the configuration of lift arm 13 may be a standard lift arm, a high lift arm, or a super high lift arm. Regardless of the configuration of lift arm 13, at least one hydraulic actuator 24 may be configured to raise and lower lift arm 13 and bucket 14, thereby controlling the relative height of bucket 14. Another hydraulic actuator 24 may be configured to rotate or pivot bucket 14 relative to lift arm 13.

Similar to lift arm 13, numerous different buckets 14 may be attachable to a single machine 10 and controllable via operator interface 16. Bucket 14 may include any loader bucket configured to perform a task such as, for example, scraping, digging, dumping, scooping or transferring a material. Bucket 14 may be connected to lift arm 13 via a direct pivot, via a linkage system, or in any other appropriate manner. Bucket 14 may be configured to pivot, rotate, slide, swing, lift, or move relative to machine 10 in any manner known in the art.

Operator interface 16 may be configured to receive input from an operator indicative of a desired movement of bucket 14. Specifically, operator interface 16 may include an interface device 26. Interface device 26 may embody, for example, a single- or multi-axis joystick located to one side of an operator station. Interface device 26 may be a proportional-type controller configured to generate signals indicative of desired positions and/or orientations of bucket 14. It is contemplated that additional and/or different interface devices may be included within operator interface 16 such as, for example, wheels, knobs, push-pull devices, switches, buttons, pedals, and other interface devices known in the art.

Power source 18 may embody an engine such as, for example, a diesel engine, a gasoline engine, a gaseous fuel-powered engine (e.g., a natural gas engine), or any other type of engine known in the art. It is contemplated that power source 18 may alternatively embody another source of power such as a fuel cell, a power storage device, an electric or hydraulic motor, or another source of power known in the art. Power source 18 may be connected to traction device 22 via transmission 20. Transmission 20 may be configured such that machine 10 and traction device 22 may operate in one or more directions and gear settings. For example, transmission 20 may have at least a reverse gear setting and one or more forward gear settings. The forward gear settings may include, for example, a first gear setting, a second gear setting, a third gear setting, a fourth gear setting, etc. Traction device 22 may include, for example, a wheel, a belt, a track or any other traction device known in the art.

Figure 2:
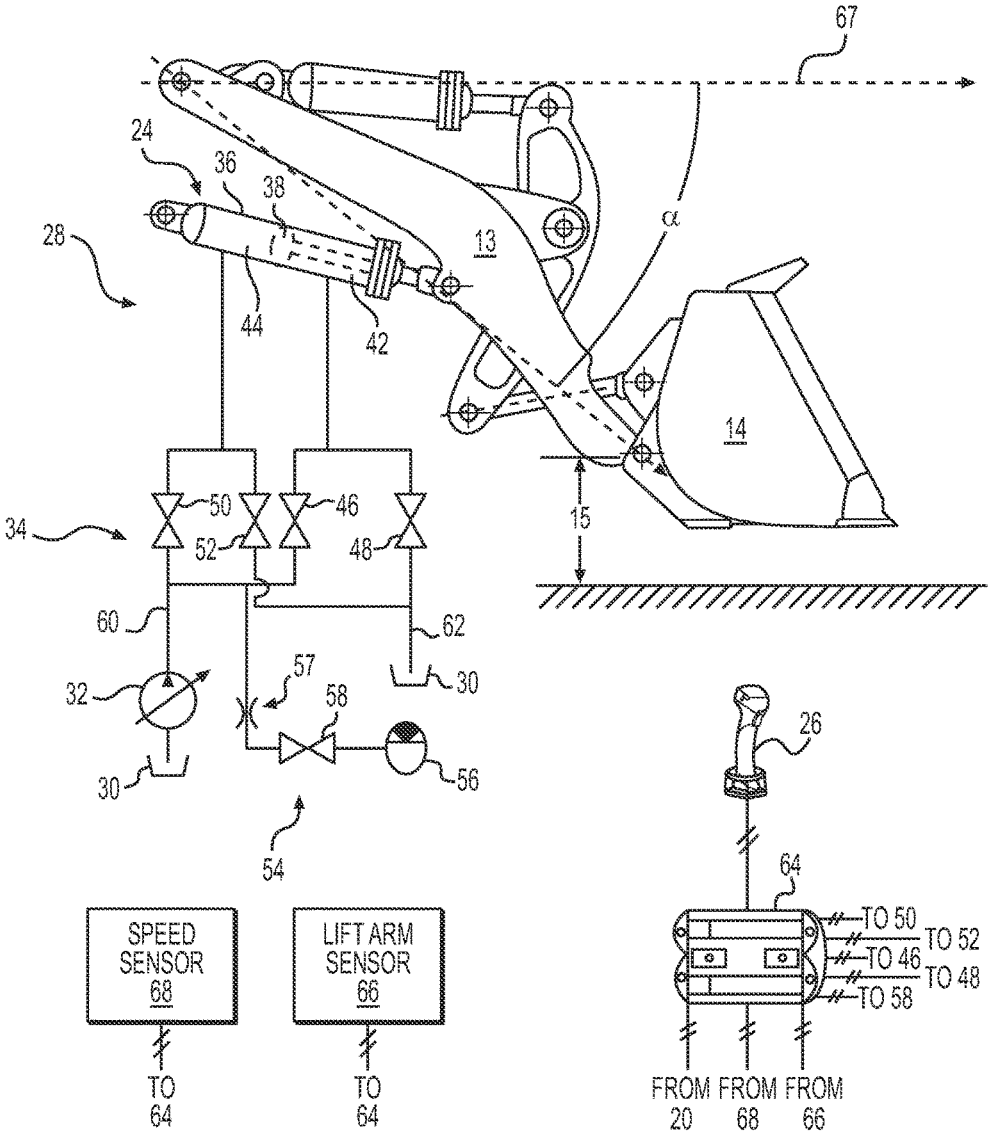
FIG. 2 is a diagrammatic and a schematic illustration of an exemplary disclosed hydraulic system that may be used with the machine of FIG. 1.

As illustrated in FIG. 2, machine 10 may include a hydraulic system 28 having a plurality of fluid components that cooperate to move lift arm 13 and bucket 14. Specifically, hydraulic system 28 may include a tank 30 holding a supply of fluid, and a pump 32 configured to draw and pressurize the fluid from tank 30, and to direct the pressurized fluid to hydraulic actuator 24. Hydraulic system 28 may also include a valve arrangement 34 disposed between hydraulic actuator 24 and tank 30/pump 32 to regulate flows of fluid to and from hydraulic actuator 24 that affect movement of lift arm 13 and bucket 14.

Tank 30 may constitute a reservoir configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to tank 30. It is also contemplated that hydraulic system 28 may be connected to multiple separate fluid tanks, if desired.

Pump 32 may be configured to produce a flow of pressurized fluid and may be, for example, a variable displacement pump, a fixed displacement variable delivery pump, a fixed displacement fixed delivery pump, or any other suitable pump. Pump 32 may be connected to power source 18 of machine 10 by, for example, a countershaft, a belt (not shown), an electrical circuit (not shown), or in any other appropriate manner. It is contemplated that multiple sources of pressurized fluid, for examples, pumps, may alternatively be interconnected to supply pressurized fluid to hydraulic system 28, if desired.

Hydraulic actuator 24 may embody a fluid cylinder that connects lift arm 13 to frame 12 via a direct pivot, via a linkage system with hydraulic actuator 24 acting as a member of the linkage system, or in any other appropriate manner. It is contemplated that a hydraulic actuator other than a fluid cylinder may alternatively be implemented within hydraulic system 28 such as, for example, a hydraulic motor or another appropriate hydraulic actuator.

As also illustrated in FIG. 2, hydraulic actuator 24 may include a tube 36, and a piston assembly 38 disposed within tube 36. One end of tube 36 and piston assembly 38 may be pivotally connected to frame 12 (see FIG. 1), while the other end of tube 36 and piston assembly 38 may be pivotally connected to lift arm 13, which may be pivotally connected to bucket 14. It is contemplated that tube 36 and/or piston assembly 38 may alternatively be fixedly connected to either frame 12 or bucket 14, if desired. Tube 36 may be divided into a rod chamber 42 and a head chamber 44 by piston assembly 38. Rod and head chambers 42, 44 may be selectively supplied with pressurized fluid from pump 32 and selectively connected with tank 30 to cause piston assembly 38 to displace within tube 36, thereby changing an effective length of hydraulic actuator 24. The expansion and retraction of hydraulic actuator 24 may function to assist in moving (e.g., lifting) lift arm 13 and bucket 14. A flow rate of fluid into and out of rod and head chambers 42, 44 may affect a velocity of hydraulic actuator 24, while a pressure of the fluid in rod and head chambers 42, 44 may affect an actuation force of hydraulic actuator 24.

Valve arrangement 34 may include one or more valves configured to perform supply and drain functions associated with the rod and head chambers 42, 44 of hydraulic actuator 24. In the embodiment of FIG. 2, valve arrangement 34 includes a rod-end supply valve 46, a rod-end drain valve 48, a head-end supply valve 50, and a head-end drain valve 52. However, it is contemplated that a different configuration including a greater or lesser number of valves may alternatively be utilized to perform the functions of valve arrangement 34, if desired. In some embodiments, for example, valve arrangement 34 could alternatively comprise only two valves, including a single head-end valve and a single rod-end valve that perform both supply and drain functions. In some embodiments, valve arrangement 34 could alternatively include a single valve capable of performing supply and drain functions for both the rod and head chambers 42, 44 of hydraulic actuator 24. Although other valve arrangement embodiments may be possible, only the first embodiment of valve arrangement 34 shown in FIG. 2 will be described in detail.

Rod-end supply valve 46 may be disposed between pump 32 and rod chamber 42 and configured to regulate a flow of pressurized fluid directed to rod chamber 42 in response to a commanded movement of bucket 14. Rod-end drain valve 48 may be disposed between rod chamber 42 and tank 30 and configured to regulate a flow of fluid from rod chamber 42 to tank 30 in response to a commanded movement of bucket 14. Head-end supply valve 50 may be disposed between pump 32 and head chamber 44 and configured to regulate a flow of pressurized fluid to head chamber 44 in response to a commanded movement of bucket 14. Head-end drain valve 52 may be disposed between head chamber 44 and tank 30 and configured to regulate a flow of fluid from head chamber 44 to tank 30 in response to a commanded movement of bucket 14. Valves 46-52 may be any type of suitable valve. For example, valves 46-52 may be configured to move between a first position, at which fluid flow is allowed, and a second position, at which fluid is blocked. In some embodiments, the valve elements may be movable to any position between the first and second positions to vary the rate of flow, thereby affecting the velocity of hydraulic actuator 24. In some embodiments, valves 46-52 may be independent metering valves (IMV), each having a proportional spring-biased valve element (not shown) that is solenoid actuated.

Hydraulic system 28 may also include a ride control arrangement 54 configured to dampen or cushion unintended movements of bucket 14 (i.e., movements not requested by the operator of machine 10 via interface device 26) during travel of machine 10. Ride control arrangement 54 may include an accumulator 56 and an accumulator valve 58. Accumulator valve 58 may be operable to selectively allow pressurized fluid through accumulator valve 58.

Accumulator 56 may selectively communicate with rod chamber 42 and head chamber 44 by way of accumulator valve 58 to selectively receive pressurized fluid from and direct pressurized fluid to hydraulic actuator 24. In particular, accumulator 56 may be any type of suitable pressure vessel or other storage device filled with a compressible gas and configured to store pressurized fluid for future use as a source of fluid power. The compressible gas may include, for example, nitrogen or another appropriate compressible gas. As fluid within head chamber 44 exceeds a predetermined pressure while accumulator valve 58 and head-end supply valve 50 are in flow passing positions, fluid from head chamber 44 and/or pump 32 may flow into accumulator 56. Because the nitrogen gas is compressible, it may act like a spring and compress as the fluid flows into accumulator 56. This compression may essentially absorb some of the bouncing energy of bucket 14, making for a smoother ride of machine 10. When the pressure of the fluid within head chamber 44 then drops below a predetermined pressure while accumulator valve 58 and head-end supply valve 50 are in the flow passing positions, the compressed nitrogen within accumulator 56 may urge the fluid from accumulator 56 back into head chamber 44.

In some embodiments, to help smooth out pressure oscillations within hydraulic actuator 24, hydraulic system 28 may absorb some energy from the fluid as the fluid flows between head chamber 44 and accumulator 56. The damping mechanism that accomplishes this may include, for example, a restrictive orifice 57 disposed within either accumulator valve 58 or within a fluid passageway between accumulator 56 and head chamber 44. Each time lift arm 13 and bucket 14 moves in response to travel across uneven terrain, fluid may be squeezed through restrictive orifice 57, and the energy expended to force the oil through restrictive orifice 57 may be converted into heat, which may then be dissipated from hydraulic system 28. This dissipation of energy from the fluid may essentially absorb some of the bouncing energy, making for a smoother ride of machine 10.

Accumulator valve 58, in one example, may be disposed in parallel with head-end supply valve 50, and between accumulator 56 and head chamber 44. Accumulator valve 58 may be configured to regulate the flows of pressurized fluid between accumulator 56 and head chamber 44. Specifically, accumulator valve 58 may be configured to move between a first position, at which fluid is blocked from flowing between head chamber 44 and accumulator 56, and a second position, at which fluid is allowed to flow between head chamber 44 and accumulator 56. In some embodiments, accumulator valve 58 may be, for example, an IMV having a proportional spring-biased valve element.

When a ride control mode of operation has been activated or is active (i.e., when the ride control command has been issued), it is contemplated in some embodiments that instead of restrictive orifice 57, the valve element of accumulator valve 58 may instead be controllably moved to any position between the flow passing and the flow blocking positions to vary the restriction and associated rate of fluid flow between head chamber 44 and accumulator 56. In this manner, accumulator valve 58 may affect the cushioning of hydraulic actuator 24 during travel of machine 10.

Rod- and head-end supply valves 46, 50 may be connected in parallel to a common supply passageway 60 extending from pump 32. Rod- and head-end drain valves 48, 52 may be connected in parallel to a common drain passageway 62 leading to tank 30. Rod-end supply and drain valves 46, 48 may be connected to a common passageway extending from the valves to rod chamber 42. Head-end supply and drain valves 50, 52 may be connected to a common passageway extending from the valves to head chamber 44. Accumulator valve 58 may be fluidly interconnected to rod- and head-end supply and drain valves 46-52.

For example, accumulator valve 58 may be connected to common supply passageway 60 via a t-connection. In some embodiments, accumulator valve 58 may be connected to other passageways of hydraulic system 28.

Hydraulic system 28 may further include a controller 64 in communication with the other components of hydraulic system 28. Controller 64 may embody a single microprocessor or multiple microprocessors that include a means for controlling an operation of hydraulic system 28. Numerous commercially available microprocessors can be configured to perform the functions of controller 64. It should be appreciated that controller 64 could readily embody a general machine microprocessor capable of controlling numerous machine functions. Controller 64 may include a memory, a secondary storage device, a processor, and any other components for running an application. Various other circuits may be associated with controller 64 such as power supply circuitry, signal conditioning circuitry, solenoid driver circuitry, and other types of circuitry.

Controller 64 may be configured to receive input from interface device 26 and command a movement of bucket 14 via hydraulic actuator 24 and lift arm 13 in response to the input. Specifically, controller 64 may be in communication with rod- and head-end supply and drain valves 46-52 of hydraulic actuator 24 and with interface device 26. Controller 64 may receive the interface device movement signal from interface device 26, and then control rod- and head-end supply and drain valves 46-52 to selectively fill or drain rod and head chambers 42, 44 to produce the desired movement of lift arm 13 and bucket 14.

Controller 64 may also be configured to selectively activate and deactivate the ride control mode of operation. In particular, controller 64 may automatically activate and deactivate the ride control mode of operation based one or more inputs, as will be described in more detail below. In some embodiments, the ride control mode may be manually triggered by an input. For example, a button, switch, or other operator control device (not shown) may be associated with the operator station that, when manually engaged by a machine operator, causes controller 64 to enter the ride control mode of operation. In some embodiments, controller 64 may be configured such that the ride control mode may not be entered manually, but instead is only entered automatically.

When the ride control mode of operation is activated, controller 64 may cause the valve elements of rod-end supply valve 46 and head-end drain valve 52 to move to or remain in the flow blocking positions. Controller 64 may simultaneously or subsequently move the valve elements of rod-end drain valve 48, head-end supply valve 50, and accumulator valve 58 to the flow passing positions. As described above, accumulator valve 58 may be moved to the flow passing position to allow fluid to flow between head chamber 44 and accumulator 56 for absorption of energy from the fluid each time the fluid passes through the restrictive orifice and into accumulator 56. Head-end supply valve 50 may be moved to the flow passing position to allow fluid flow between accumulator valve 58 and head chamber 44. Rod-end drain valve 48 may be moved to the flow passing position to prevent hydraulic lock during an up-bounce of bucket 14 as fluid is flowing from accumulator 56 into head chamber 44. It is also contemplated that the valve elements of rod-end drain valve 48 and head-end supply valve 50 may be selectively positioned between the flow passing and flow blocking positions to vary the restriction of the fluid exiting and/or entering rod and head chambers 42, 44, thereby adjusting dampening during the ride control mode of operation. To minimize undesired movements of bucket 14, upon initiation of the ride control mode of operation, the pressure of the fluid within accumulator 56 may be substantially matched to the pressure within head chamber 44 in a conventional manner, before fluid communication is established between accumulator 56 and head chamber 44, if desired.

One or more sensors may be associated with controller 64 and machine 10 and configured to supply one or more of the inputs used by controller 64 to selectively activate and deactivate the ride control mode of operation. For example, a lift arm sensor 66 may be associated with machine 10 and configured to generate an angle signal indicative of an angle of the lift arm 13. Specifically, lift arm sensor 66 may be configured to measure an angle $\alpha$ of lift arm 13 relative to a longitudinal axis 67 of machine 10, as shown in FIG. 2. Angle $\alpha$ and the dimensions of lift arm 13, may determine the relative height 15 of bucket 14 (where it connects to lift arm 13), off the ground. Varying angle $\alpha$ or the dimensions of lift arm 13 may change height 15 of bucket 14 at the pivot point where lift arm 13 connects to bucket 14. A speed sensor 68 may be configured to monitor a speed of machine 10, for example a rotational speed of traction device 22 or a travel speed of machine 10. Speed sensor 68 may generate a signal indicative of the speed measurement and send this signal to controller 64.

Controller 64 may also be configured to receive an input from transmission 20. For example, controller 64 may be configured to communicate with (e.g., receive a signal from) transmission 20 and responsively determine a gear setting of transmission 20. For example, controller 64 may be configured to determine (based on the signal from transmission 20) whether the gear setting of transmission 20 is a reverse gear setting or a forward gear setting. In addition, if the setting of transmission 20 is a forward gear setting, controller 64 may also be configured to determine which gear setting it is (e.g., first gear, second gear, third gear, etc.).

Controller 64 may also be configured to directly determine a dig trigger signal status or, in some embodiments, indirectly via another controller associated with machine 10. The dig trigger signal status may either be on (e.g., equal to one) or off (e.g., equal to zero). The dig trigger signal status may be indicative of whether a dig operation using bucket 14 has been initiated by machine 10. The dig trigger signal status may be configured to latch once a dig operation has been initiated. For example, the dig trigger signal status may be latched "on" when one or more inputs correspond to or are within one or more threshold ranges, which may indicate a dig operation has been initiated. According to an exemplary embodiment, the dig trigger signal status may be latched "on" when the speed of machine 10 is less than a speed threshold (e.g., less than 2 miles per hour), the gear setting of transmission is equal to a particular gear setting for a specified time period (e.g., equal to forward-first gear for at least 2.5 seconds), angle $\alpha$ of lift arm 13 is less than an angle threshold (e.g., less than about −25 degrees), bucket 14 is at an angle less than a bucket angle threshold (e.g., less than about 30 degrees), and an overall load on power source 18 is greater than a load threshold (e.g., greater than about 70%). In some embodiments, the dig trigger signal status may be determined based on any combination of these parameters. Clearing or unlatching of the dig trigger signal status (i.e., setting the status to off or to zero) may be based on one or more inputs, which will be discussed in more detail further along with regard to FIG. 5.

Figure 3:
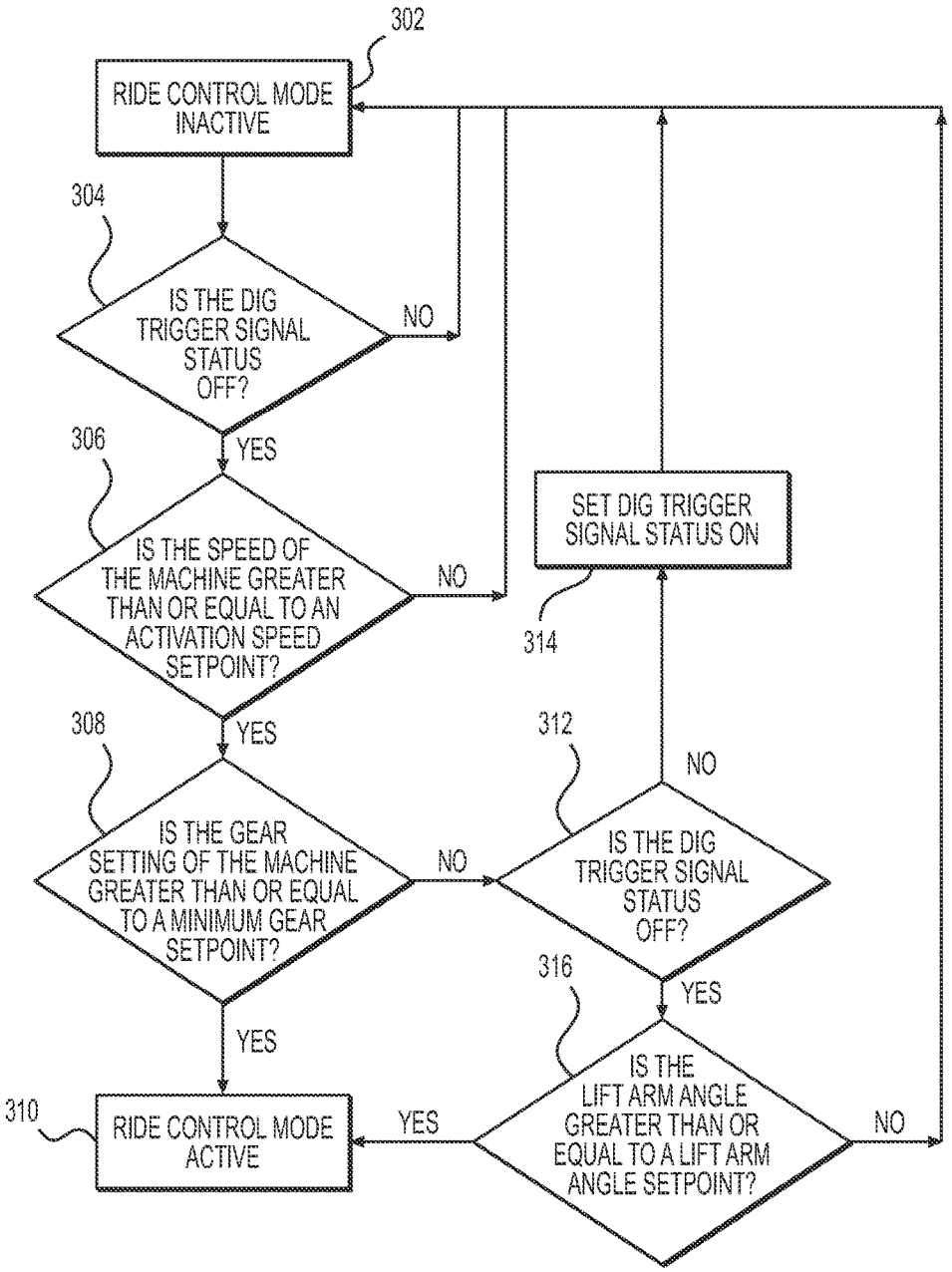
FIG. 3 is a flowchart depicting an exemplary disclosed operation that may be performed by the hydraulic system of FIG. 2.
Figure 4:
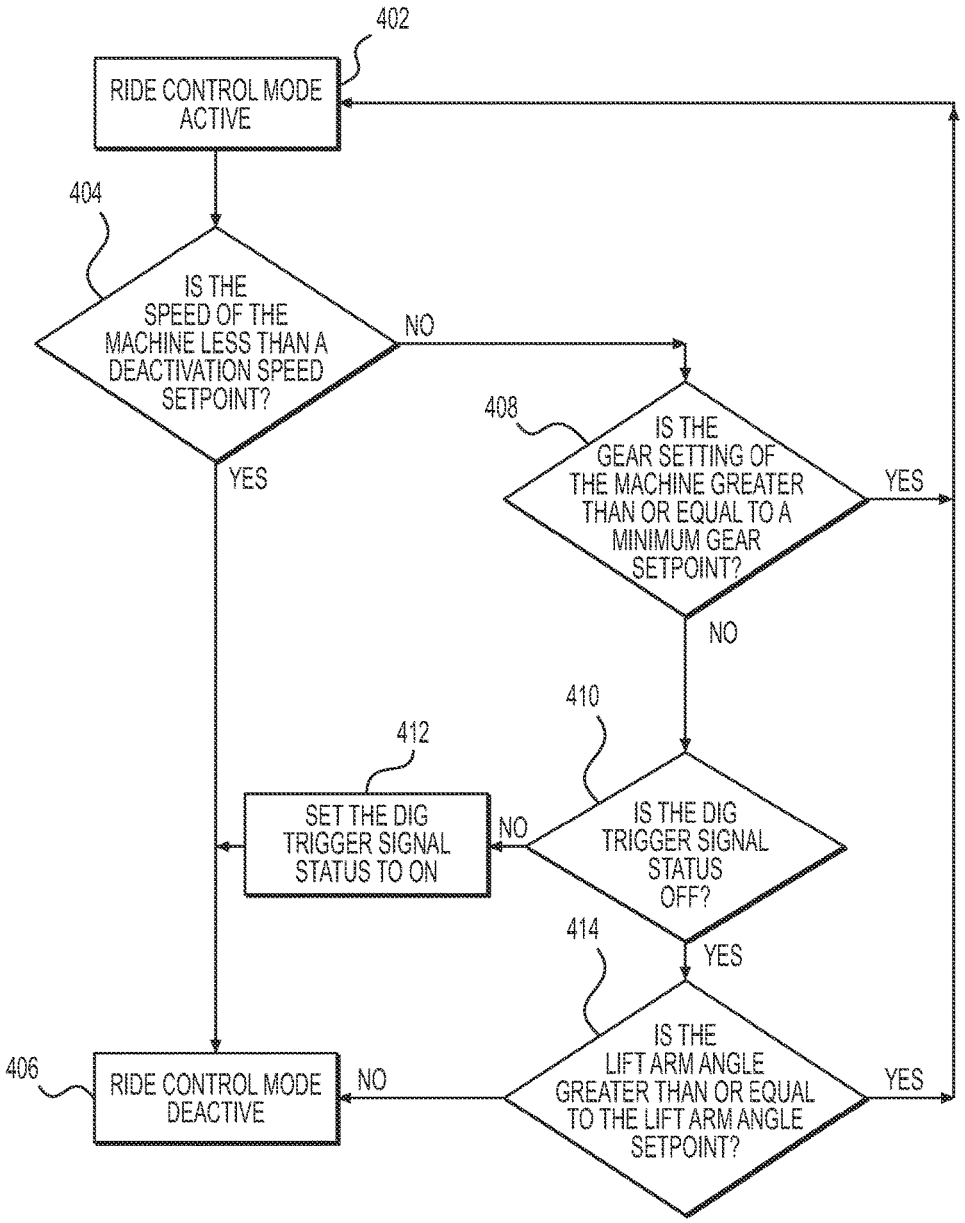
FIG. 4 is a flowchart depicting another exemplary disclosed operation that may be performed by the hydraulic system of FIG. 2.
Figure 5:
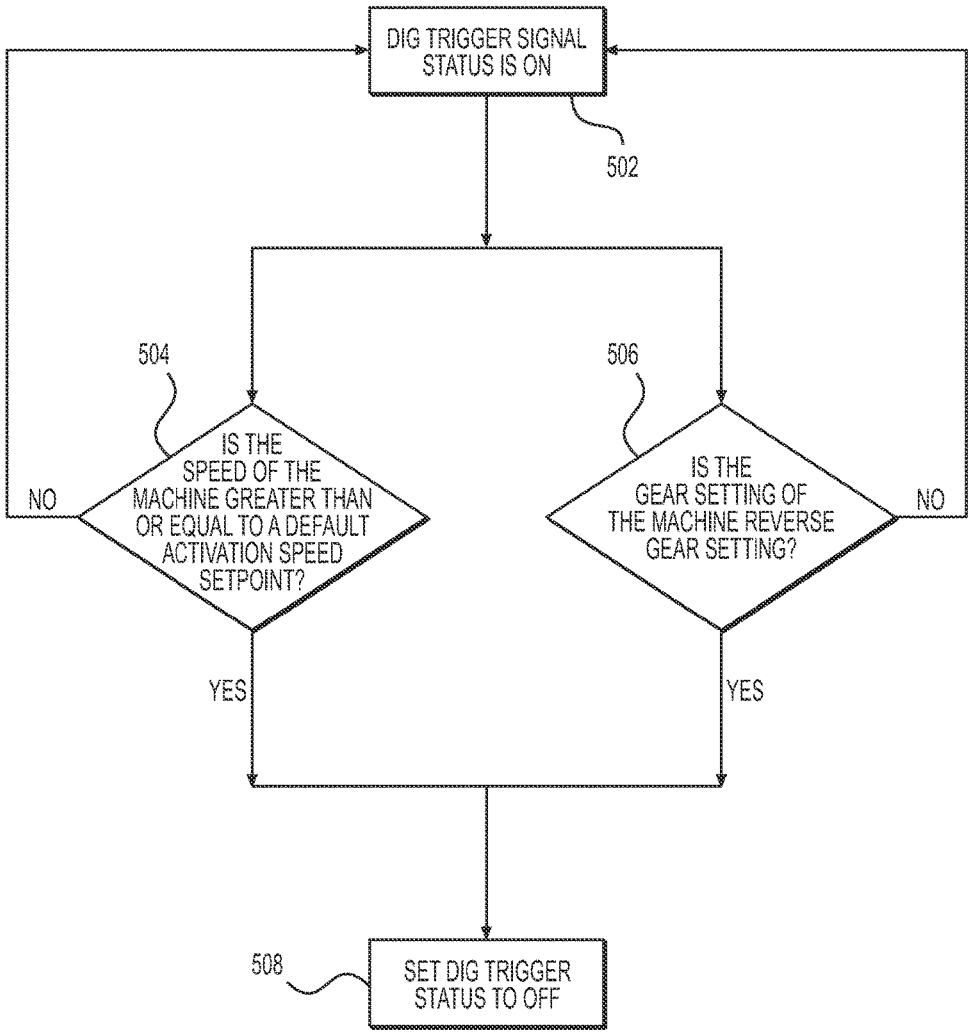
FIG. 5 is a flow chart depicting yet another exemplary disclosed operation that may be performed by the hydraulic system of FIG. 2.

FIG. 3 illustrates an exemplary process performed by controller 64 during operation of machine 10 that activates the ride control mode of operation. FIG. 4 illustrates an exemplary process performed by controller 64 during operation of machine 10 that deactivates the ride control mode of operation. FIG. 5 illustrates an exemplary process performed by controller 64 during operation of machine 10 that clears the dig trigger signal status. FIGS. 3-5 will be described in detail in the following section to further illustrate the disclosed concepts.

INDUSTRIAL APPLICABILITY

The disclosed hydraulic system may be applicable to any mobile machine that includes a hydraulic actuator connected to a lift arm of a bucket. The disclosed hydraulic system may improve a ride control mode of operation by enabling and disabling a ride control mode of operation based on an angle of the bucket when a transmission gear setting of the machine is below a minimum gear setpoint. The operation of hydraulic system 28 will now be explained.

During operation of machine 10, a machine operator may manipulate interface device 26 to control a movement (e.g., a height) of bucket 14 via lift arm 13. The manipulation of interface device 26 may be related to an operator's expected or desired movement of bucket 14. Interface device 26 may generate a position signal indicative of the operator's expected or desired movement of bucket 14 and send this position signal to controller 64.

Controller 64 may be configured to receive the interface device position signal and then send corresponding signals to rod- and head-end supply and drain valves 46-52 to regulate the flow of pressurized fluid into and out of rod and head chambers 42, 44. In this manner, controller 64 may cause movements of hydraulic actuator 24 that substantially match the operator expected or desired movements.

Accumulator 56 and accumulator valve 58 may be used when the ride control mode of operation is activated. Specifically, when controller 64 automatically activates the ride control mode of operation, controller 64 may move the valve elements of rod-end supply valve 46 and head-end drain valve 52 to the flow blocking positions (or retain them in the flow blocking positions if already in the flow blocking positions) and move the valve elements of accumulator valve 58, head-end supply valve 50, and rod-end drain valve 48 to the flow passing positions. When in the ride control mode of operation, fluid may be allowed to drain from rod chamber 42 and flow into and out of head chamber 44. As fluid both leaves rod chamber 42 and flows into and out of head chamber 44, the fluid flow may be restricted to absorb and dissipate bounce energy from the movement of bucket 14.

Controller 64 may selectively activate (e.g., automatically) the ride control mode of operation based on signals received from lift arm sensor 66 and speed sensor 68, as well as other input parameters (e.g., the gear setting and the dig trigger signal status). Specifically, as illustrated in the flowchart of FIG. 3, activation of the ride control mode is started from an inactive state (Step 302). From step 302, controller 64 may then determine whether the dig trigger signal status is off (e.g., unlatched) (Step 304). As described herein, a plurality of inputs may be used to determine the dig trigger signal status, which may be indicative of whether a dig has been initiated by bucket 14. If a dig has been initiated then the dig trigger signal status will be "on" (e.g., latched) (Step 304: No), and controller 64 may return to step 302. If a dig has not been initiated or the status has been cleared or unlatched, that is the dig trigger signal status is "off" (e.g., unlatched) (Step 304: Yes), controller 64 may proceed to step 306.

At step 306, controller 64 may determine whether the speed of machine 10 is greater than or equal to an activation speed setpoint. For example, controller 64 may compare the speed signal received from speed sensor 68 to the activation speed setpoint. In some embodiments, the activation speed setpoint may be operator-adjustable via operator interface 16, between a minimum value and a maximum value. According to an exemplary embodiment, the activation speed setpoint may be about 2.0 miles per hour or 3.2 kilometers per hour. If the speed of machine 10 is not greater than or equal to the activation speed setpoint (Step 306: No), controller 64 may return to step 302. If the speed of machine 10 is greater than or equal to the activation speed setpoint (Step 306: Yes), controller 64 may proceed to step 308.

At step 308, controller 64 may determine whether the gear setting of machine 10 is greater than or equal to a minimum gear setpoint. According to an exemplary embodiment, the minimum gear setpoint may be, for example, third gear. In some embodiments, the minimum gear setpoint may be greater than or less than third gear, for example, second gear or fourth gear. If the gear setting is greater than or equal to the minimum gear setpoint (Step 308: Yes), controller 64 may proceed to step 310 and activate the ride control mode of operation. If the gear setting is less than the minimum gear setpoint (Step 308: No), controller 64 may proceed to step 312.

At step 312, controller 64 may determine whether the dig trigger signal status is "off" (Step 312). Controller 64 may determine whether the dig trigger signal status is "off" by comparing the dig trigger signal inputs to the threshold ranges. If the dig trigger signal inputs are not within the threshold ranges then the dig trigger signal status may be "off," indicative that a dig operation may not have been initiated. If the dig trigger signal inputs are within the threshold ranges then the dig trigger signal status may be "on," indicative that a dig operation may have been initiated. If the digger trigger signal status is "on" (Step 312: No), controller 64 may proceed to step 314 and set or latch dig trigger signal status "on" (Step 314), and then proceed back to step 302. If the digger trigger signal status is "off" (Step 312: Yes), controller 64 may proceed to step 316.

At step 316, controller 64 may determine whether the lift arm angle $\alpha$ is greater than or equal to a lift arm angle setpoint (Step 316). The lift arm angle setpoint may vary depending on the model of machine 10, the model of lift arm 13, or the model of bucket 14. For example, when using a standard-lift arm, the lift arm angle setpoint may be about −28 degrees. However, for a high-lift arm the setpoint may be about −30 degrees. The setpoints may be adjusted so that height 15 remains about the same, despite the change in the lift arm. For example, setpoints of −28 degrees and −30 degrees for the standard-lift arm and for the high-lift arm may correspond to a height 15 of about 20 inches. In some embodiments, the lift arm setpoint may be set such that it corresponds to a height 15 greater than or less than 20 inches. If the lift arm angle $\alpha$ is not greater than or equal to the lift arm angle setpoint (Step 316: No), controller 64 may return to step 302. If lift arm angle $\alpha$ is greater than or equal to the lift arm angle setpoint (Step 316: Yes), controller 64 may proceed to step 310 and activate the ride control mode of operation.

Once the ride control mode of operation is activated, controller 64 may automatically deactivate the ride control mode of operation based on signals received from lift arm sensor 66 and speed sensor 68, as well as other inputs (e.g., the gear setting and the dig trigger signal status). Specifically, as illustrated in the flowchart of FIG. 4, deactivation of the ride control mode is started from an active state (Step 402). From step 402, controller 64 may then determine whether the speed of machine 10 is less than a deactivation speed setpoint (Step 404). For example, controller 64 may compare the speed signal received from speed sensor 68 to the deactivation speed setpoint. In some embodiments, the deactivation speed setpoint may be operator-adjustable via operator interface 16, between a minimum value and a maximum valve. In other embodiments, the deactivation speed setpoint may be hard-coded, such that it is not operator-adjustable. According to an exemplary embodiment, the deactivation speed setpoint is about 0.6 miles per hour or about 1 kilometer per hour below the activation speed setpoint (e.g., 1.4 miles per hour or 2.2 kilometers per hour). If the speed of machine 10 is less than the deactivation speed setpoint (Step 404: Yes), controller 64 may proceed to step 406 and deactivate the ride control mode of operation. If the speed of machine 10 is not less than the deactivation speed setpoint (Step 404: No), controller 64 may proceed to step 408.

At step 408, controller 64 may determine whether the gear setting of machine 10 is greater than or equal to the minimum gear setpoint. If the gear setting of machine 10 is greater than or equal to the minimum gear setpoint (Step 408: Yes), controller 64 may return to step 402 and the ride control mode may remain active. If the gear setting of machine 10 is not greater than or equal to the minimum gear setpoint (Step 408: No), controller 64 may proceed to step 410.

At step 410, controller 64 may determine whether the dig trigger signal status is "off" Controller 64 may determine whether the dig trigger signal status is "off" by comparing the dig trigger signal inputs to the threshold ranges. If the dig trigger signal inputs are not within the threshold ranges then the dig trigger signal status may be "off," indicative that a dig operation may not have been initiated. If the dig trigger signal inputs are within the threshold ranges then the dig trigger signal status may be "on," indicative that a dig operation may have been initiated. If the digger trigger signal status is "on" (Step 410: No), controller 64 may proceed to the next step and set or latch the dig trigger signal status "on" (Step 412), and then proceed to step 406 and deactivate the ride control mode of operation. If the digger trigger signal status is "off" (Step 410: Yes), controller 64 may proceed to step 414.

At step 414, controller 64 may determine whether the lift arm angle $\alpha$ is greater than or equal to the lift arm angle setpoint (Step 414). If lift arm angle $\alpha$ is greater than the lift arm angle setpoint (Step 414: Yes), controller 64 may return to step 402 and the ride control mode may remain active. If the lift arm angle $\alpha$ is not greater than or equal to the lift arm angle setpoint (Step 414: No), controller 64 may proceed to step 406 and deactivate the ride control mode of operation. Utilizing the lift arm angle $\alpha$ to determine whether to deactivate the ride control mode when the gear setting is below a minimum gear setting enables machine 10 to operate over a greater range of operating conditions. For example, according to FIG. 4, machine 10 may continue operating with the ride control mode of operation active, despite the gear setting being below a minimum gear (e.g., first gear or second gear).

Controller 64 may automatically clear or unlatch the dig trigger signal status (i.e., set to "off") based on signals received from, for example, speed sensor 68, as well as other inputs (e.g., the gear setting). Specifically, as illustrated in the flowchart of FIG. 5, unlatching the dig trigger signal status is started from a latched dig trigger signal status of "on" (Step 502). Controller 64 may then determine whether the speed of machine 10 is greater than or equal to a default activation speed setpoint (Step 504). The default activation speed setpoint may vary. According to an exemplary embodiment, the default activation speed setpoint may be about 5 miles per hour or about 8 kilometers per hour. If the speed of machine 10 is greater than or equal to the default activation speed setpoint (Step 504: Yes), controller 64 may proceed to step 508 and clear or unlatch the dig trigger signal status (i.e., set to "off") (Step 508). If the speed of machine 10 is not greater than or equal to the default activation speed setpoint (Step 504: No), controller 64 may return to step 502 and the dig trigger status may remain latched "on."

In parallel to step 504, controller 64 may be configured to determine whether the gear setting of machine 10 is a reverse gear setting (Step 506). If the gear setting is not a reverse gear setting (Step 506: No), controller 64 may return to step 502 and the dig trigger signal status may remain latched "on." If the gear setting is a reverse gear setting (Step 506: Yes), controller 64 may proceed to step 508 and clear or unlatch the dig trigger status (i.e., set to "off").

The clearing or unlatching of the dig trigger signal status may be configured such that the ride control mode of operation may not be activated during a dig. In some embodiments, controller 64 may be configured to execute just step 504 or just step 506 in order to determine whether to clear the dig trigger signal status.

In some embodiments, controller 64 may be configured to selectively activate and deactivate the ride control mode of operation without the use of the dig trigger signal status. For example, for the flow chart of FIG. 3, steps 304, 312, and 314 may be eliminated, while everything else may remain the same. In another example, for the flow chart of FIG. 4, steps 410 and 412 may be eliminated, while everything else may remain the same. The use of the dig trigger signal status in the activation logic of the ride control mode (FIG. 3) and deactivation logic of the ride control mode (FIG. 4) may provide a more robust control logic for controller 64. For example, in a situation where an operator engages a pile with lift arm 13 and bucket 14 at a height higher than recommended, resulting in the lift arm angle $\alpha$ being greater than expected (i.e., greater than the lift arm angle setpoint), which may not ordinarily deactivate the ride control mode of operation, the dig trigger signal status may still be set "on," thereby deactivating the ride control mode of operation.

In some embodiments, controller 64 may be configured to perform one or more functions if a failure of one or more sensors or inputs is detected. For example, if the lift arm sensor 66 malfunctions (e.g., the lift arm angle signal is faulty), and the gear setting of transmission 20 is less than the minimum gear setpoint, then controller 64 may adjust the activation speed setpoint to a fault activation speed setpoint. In some embodiments, the fault activation speed setpoint may be equal to the default activation speed setpoint. In another example, if controller 64 fails to receive either of the speed signal and the dig trigger signal, or fails to determine the gear setting, then controller 64 may be configured to disable the ride control mode of operation. In yet another example, if controller 64 fails to receive the speed signal, then controller 64 may be configured to disable the ride control mode of operation.

Because the disclosed ride control mode of operation may be selectively activated and deactivated automatically based on the lift arm angle when the gear setting is below a minimum gear setpoint, machine 10 may be able to operate with ride control mode of operation active even at low gear, while still preventing or reducing the likelihood of a digging operation being performed while the ride control mode is active.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system for a mobile machine having a lift arm attached to a bucket and a transmission, the hydraulic system comprising:

a hydraulic actuator configured to move the lift arm and bucket;

an accumulator configured to store pressurized fluid;

an accumulator valve configured to control fluid flow between the accumulator and the hydraulic actuator, for a ride control mode of operation configured to cushion movement of the bucket;

a lift arm sensor associated with the mobile machine and configured to generate an angle signal indicative of an angle of the lift arm;

a speed sensor associated with the mobile machine and configured to generate a speed signal indicative of the speed of the mobile machine; and a controller in communication with the accumulator valve, the lift arm sensor, the speed sensor, and the transmission, the controller being configured to:

receive the speed signal;

determine a gear setting of the transmission;

receive the angle signal; and selectively activate and deactivate the ride control mode of operation based on the speed of the mobile machine and the angle of the lift arm when the gear setting of the transmission is below a minimum gear setpoint.

2. The hydraulic system of claim 1, wherein the controller is further configured to:

determine a dig trigger signal status; and selectively activate and deactivate the ride control mode of operation based further on the dig trigger signal status.

3. The hydraulic system of claim 2, wherein the controller is configured to activate the ride control mode of operation when:

the dig trigger signal status is "off," the speed of the mobile machine is greater than or equal to an activation speed setpoint, and the gear setting of the transmission is greater than or equal to the minimum gear setpoint; or the dig trigger signal status is "off," the speed of the mobile machine is greater than or equal to the activation speed setpoint, the gear setting of the transmission is less than the minimum gear setpoint, and the angle of the lift arm is greater than or equal to a lift arm angle setpoint.

4. The hydraulic system of claim 2, wherein the controller is configured to deactivate the ride control mode of operation when:

the speed of the mobile machine is less than a deactivation speed setpoint;

the speed of the mobile machine is greater than or equal to the deactivation speed setpoint, the gear setting of the transmission is less than the minimum gear setpoint, and the dig trigger signal status is "on"; or the speed of the mobile machine is greater than or equal to the second speed setpoint, the gear setting of the transmission is less than the minimum gear setpoint, the dig trigger signal status is "off," and the angle of the lift arm is less than a lift arm angle setpoint.

5. The hydraulic system of claim 2, wherein the controller is configured to set the dig trigger signal status to "off" when the controller determines that the gear setting of the transmission is a reverse gear setting.

6. The hydraulic system of claim 2, wherein the controller is configured to set the dig trigger signal status to "off" when the controller determines the gear setting of the transmission is a reverse gear setting or when the speed of the mobile machine is greater than or equal to a default activation speed setpoint.

7. The hydraulic system of claim 2, wherein, if the lift arm sensor malfunctions and the gear setting of the transmission is less than the minimum gear setpoint, the controller is configured to adjust an activation speed setpoint required for activation of the ride control mode of operation to a default activation speed setpoint.

8. The hydraulic system of claim 2, wherein, if the controller fails to receive the speed signal and fails to determine the dig trigger signal status, or fails to determine the gear setting of the transmission, then the controller is configured to disable the ride control mode of operation.

9. The hydraulic system of claim 2, wherein, if the controller fails to receive the speed signal, then the controller is configured to disable the ride control mode of operation.

10. A method for controlling motion of a bucket during travel of a machine, the method comprising:

determining a speed of the machine;

determining a transmission gear setting of the machine;

determining an angle of a lift arm attached to the bucket;

selectively activating or deactivating a ride control mode of operation, based on the speed of the machine and the angle of the lift arm when the gear setting of the transmission is below a minimum gear setpoint.

11. The method of claim 10, further including:

determining a dig trigger signal status;

wherein selectively activating or deactivating the ride control mode of operation includes selectively activating or deactivating the ride control mode of operation based further on the dig trigger signal status.

12. The method of claim 11, wherein selectively activating the ride control mode of operation includes selectively activating the ride control mode of operation when:

the dig trigger signal status is "off," the speed of the machine is greater than or equal to an activation speed setpoint, and the gear setting of the transmission is greater than or equal to the minimum gear setpoint; or the dig trigger signal status is "off," the speed of the machine is greater than or equal to the activation speed setpoint, the gear setting of the transmission is less than the minimum gear setpoint, and the angle of the lift arm is greater than or equal to a lift arm angle setpoint.

13. The method of claim 11, wherein selectively deactivating the ride control mode of operation includes selectively deactivating the ride control mode of operation when:

the speed of the machine is less than a deactivation speed setpoint;

the speed of the machine is greater than or equal to the deactivation speed setpoint, the gear setting of the transmission is less than the minimum gear setpoint, and the dig trigger signal status is "on"; or the speed of the machine is greater than or equal to the second speed setpoint, the gear setting of the transmission is less than the minimum gear setpoint, the dig trigger signal status is "off," and the angle of the life arm is less than a lift arm angle setpoint.

14. The method of claim 11, further including setting the dig trigger signal status to "off" when it is determined that the gear setting of the transmission is a reverse gear setting.

15. The method of claim 11, further including setting the dig trigger signal status to "off" when it is determined that the gear setting of the transmission is a reverse gear setting or when the speed of the machine is greater than or equal to a default activation speed setpoint.

16. The method of claim 11, wherein, if determining the angle of the lift arm fails, and the gear setting of the transmission is less than the minimum gear setpoint, then the method includes adjusting an activation speed setpoint required for activation of the ride control mode of operation to a default activation speed setpoint.

17. The method of claim 11, wherein, if determining of the speed of the machine fails, determining of the dig trigger signal status fails, or determining of the gear setting of the transmission fails, then the method includes disabling the ride control mode of operation.

18. The method of claim 11, wherein, if determining of the speed of the machine fails, then the method includes disabling the ride control mode of operation.

19. A machine, comprising:

a power source and a transmission;

a traction device controlled by the transmission to propel the machine;

a bucket attached to a lift arm;

a hydraulic actuator configured to move the lift arm and the bucket;

a tank configured to hold a supply of fluid;

a pump driven by the power source to draw and pressurize fluid from the tank;

a valve arrangement configured to control fluid flow between the hydraulic actuator, the tank, and the pump to affect movement of the bucket;

an accumulator configured to store pressurized fluid;

an accumulator valve configured to control fluid flow between the accumulator and the hydraulic actuator, for a ride control mode of operation;

a lift arm sensor associated with the machine configured to generate an angle signal indicative of an angle of the lift arm;

a speed sensor associated with the machine configured to generate a speed signal indicative of the speed of the machine; and a controller in communication with the valve arrangement, the accumulator valve, the lift arm sensor, the speed sensor, and the transmission, the controller being configured to:

receive the speed signal;

determine a gear setting of the transmission;

receive the angle signal; and selectively activate the ride control mode of operation and open the accumulator valve based on the speed of the machine and the angle of the lift arm when the gear setting of the transmission is below a minimum gear setpoint.

20. The machine of claim 19, wherein the controller is further configured to:

determine a dig trigger signal status; and selectively activate and deactivate the ride control mode of operation based further on the dig trigger signal status.

* * * * *